US005747438A

United States Patent [19]

MacBeath

[11] Patent Number: 5,747,438

[45] Date of Patent: May 5, 1998

[54] MACHINE DISHWASHING DETERGENT CONTAINING COATED PERCARBONATE AND AN ACIDIFICATION AGENT TO PROVIDE DELAYED LOWERED PH

[75] Inventor: Fiona Susan MacBeath, Newcastle, United Kingdom

[73] Assignee: The Procter & Gamble Company, Cincinnati, Ohio

[21] Appl. No.: 633,764

[22] PCT Filed: Oct. 21, 1994

[86] PCT No.: PCT/US94/12246

§ 371 Date: Apr. 19, 1996

§ 102(e) Date: Apr. 19, 1996

[87] PCT Pub. No.: WO95/12657

PCT Pub. Date: May 11, 1995

[30] Foreign Application Priority Data

Nov. 3, 1993 [EP] European Pat. Off. ..... 93308800

[51] Int. Cl.[6] ..... C11D 7/08; C11D 7/18

[52] U.S. Cl. ..... 510/224; 510/375; 510/376; 510/441; 252/186.27; 252/186.38

[58] Field of Search ..... 252/186.27, 186.32, 252/186.38; 510/224, 229, 375, 441, 376

[56] References Cited

U.S. PATENT DOCUMENTS

| | | | |
|---|---|---|---|
| 3,779,931 | 12/1973 | Fries et al. | 510/307 |
| 4,105,827 | 8/1978 | Brichard et al. | 428/403 |
| 4,326,976 | 4/1982 | Logan et al. | 510/375 |
| 4,483,778 | 11/1984 | Thompson et al. | 510/312 |
| 4,486,327 | 12/1984 | Murphy et al. | 510/312 |
| 4,536,314 | 8/1985 | Hardy et al. | 510/312 |
| 4,988,363 | 1/1991 | Barnes | 8/111 |
| 5,106,528 | 4/1992 | Francis et al. | 252/186.23 |
| 5,236,616 | 8/1993 | Oakes et al. | 252/186.38 |
| 5,405,413 | 4/1995 | Willey et al. | 252/186.39 |
| 5,505,740 | 4/1996 | Kong et al. | 252/186.27 |

FOREIGN PATENT DOCUMENTS

| | | | |
|---|---|---|---|
| 396287 | 11/1990 | European Pat. Off. | C11D 3/39 |

*Primary Examiner*—Douglas J. McGinty
*Assistant Examiner*—Caroline L. Dusheck
*Attorney, Agent, or Firm*—Brian M. Bolam; Kim William Zerby

[57] ABSTRACT

There is provided a particulate solid machine dishwashing detergent composition containing alkali metal percarbonate bleach coated with a mixed salt comprising an alkali metal carbonate and an alkali metal sulphate salt; a peroxyacid bleach precursor; an acidification agent; and a means for enabling delayed release of said acidification agent such that the pH of said composition as a 1% solution in water at 20° C. is from 9.5 to 13.0 prior to release of said acidification agent, and such that the pH of said composition as a 1% solution in water at 20° C. is from 9.3 to 7.0 subsequent to complete release of said acidification agent.

11 Claims, No Drawings

MACHINE DISHWASHING DETERGENT CONTAINING COATED PERCARBONATE AND AN ACIDIFICATION AGENT TO PROVIDE DELAYED LOWERED PH

TECHNICAL FIELD

The present invention relates to particulate solid machine dishwashing detergent compositions containing a coated percarbonate bleach component, a bleach activator component, an acidification agent and a means for enabling delayed release of said acidification agent into the wash solution.

BACKGROUND OF THE INVENTION

Detergent compositions designed for use in automatic dishwasher machines are well known, and a consistent effort has been made by detergent manufacturers to improve the cleaning and/or rinsing efficiency of said compositions on dishes and glassware, as reflected by numerous patent publications.

The inorganic perhydrate bleach most widely used in machine dishwashing detergent compositions is sodium perborate in the form of either the monohydrate or tetrahydrate. However, concerns about the impact of boron salts on the environment have led to an increasing interest in other perhydrate salts, of which sodium percarbonate is the most readily available.

Detergent compositions containing sodium percarbonate are known in the art. Sodium percarbonate is an attractive perhydrate for use in detergent compositions because it dissolves readily in water, is weight efficient and, after giving up its available oxygen, provides a source of carbonate ions to the wash solution.

The inclusion of percarbonate salts in detergent compositions has been restricted hitherto by the relative instability of such salts in the detergent matrix environment. In particular, percarbonate salt components of such detergent compositions decompose rapidly when stored in moist and/or warm atmospheres. It is known that acceptable storage characteristics may however be obtained through the protection of the percarbonate by coating the crystalline product, or by the inclusion of stabilizing agents during its manufacture, or both. A variety of suitable coating agents have been proposed including silicates and mixtures of inorganic sulphate and carbonate salts.

Laundry washing and bleaching methods using compositions containing a hydrogen peroxide source and peroxyacid bleach precursor (bleach activator) and involving an initially alkaline (e.g.: pH 10–11) wash solution, and delayed release of acid into the wash solution to provide a final wash solution of lower pH are known in the art, having been disclosed for example, in EP-A-396,287 and EP-A-290,081. Hereinafter such washing methods are referred to generally as 'controlled pH release washing methods'.

It is desirable in controlled pH release washing methods that release of the hydrogen peroxide into the wash solution occurs rapidly, enabling effective perhydrolysis of the peracid precursor whilst the pH of the wash solution is in the initial alkaline region.

Where the hydrogen peroxide source is an alkali metal percarbonate salt, the coating of the percarbonate bleach, which is necessary for its storage stability in the detergent product, will act such as to inhibit the required rapid release of hydrogen peroxide into the initial alkaline wash solution. Release of the hydrogen peroxide is particularly impaired where the initial wash solution temperature is close to room temperature, e.g.; as with 'cold fill' dishwashing machines. The overall performance of the washing method is thus impaired.

The Applicants have however obtained unexpectedly good cleaning performance where a composition containing a percarbonate bleach coated with a mixed carbonate/sulphate salt, is used in a 'controlled pH release' machine dishwashing method.

The percarbonate is formulated in combination with a bleach activator, an acidification agent and means of delayed release of said acidification agent.

The Applicants have also found that the problem of deposition of insoluble calcium carbonate salts as spots and films on the articles in the wash, which may arise when a carbonate ion source such as percarbonate is formulated in a machine dishwashing composition, is significantly reduced in washing methods including a lower pH (i.e. pH<9.5) final wash solution. Spotting and filming of tableware, and especially clear glassware, is a particular problem in machine dishwashing. The need for organic dispersant polymers, which are most commonly used to ameliorate the problem of such deposits is hence reduced.

It is an object of this invention to provide a composition suitable for use in a controlled pH release machine dishwashing method where the source of hydrogen peroxide is a coated percarbonate bleach incorporated in said composition in a form which is storage stable.

SUMMARY OF THE INVENTION

There is provided a particulate solid machine dishwashing detergent composition containing (a) from 3% to 40% by weight of alkali metal percarbonate bleach coated with a mixed salt comprising an alkali metal carbonate and an alkali metal sulphate salt;

(b) from 0.5% to 15% by weight of a peroxyacid bleach precursor;

(c) from 0.1% to 40% by weight of an acidification agent;

and a means for enabling delayed release of said acidification agent such that the pH of said composition as a 1% solution in water at 20° C. is from 9.5 to 13.0, prior to release of said acidification agent and such that the pH of said composition as a 1% solution in water at 20° C. is from 9.3 to 7.0 subsequent to complete release of said acidification agent.

DETAILED DESCRIPTION OF THE INVENTION

Coated Alkali Metal Percarbonate Bleach

The first essential component of the detergent compositions in accord with the invention is alkali metal percarbonate bleach coated with a mixed salt comprising an alkali metal carbonate and an alkali metal sulphate salt. The coated alkali metal percarbonate is present at a level of from 3% to 40%, preferably from 4% to 30%, most preferably from 5% to 25% by weight of the compositions.

The percarbonate is incorporated in coated form, which provides for storage stability of the percarbonate salt in the granular product. The coating material comprises a mixed salt of an alkali metal sulphate and carbonate. Such mixed salt coatings together with coating processes have previously been described in GB-1,466,799, granted to Interox on 9th March 1977. The weight ratio of the mixed salt coating material to percarbonate lies in the range from 1:200 to 1:4, more preferably from 1:99 to 1:9, and most preferably from 1:49 to 1:19. Preferably, the mixed salt is of sodium sulphate and sodium carbonate which has the general formula $Na_2SO_4.n.Na_2CO_3$ wherein n is from 0.1 to 3, preferably n is from 0.3 to 1.0 and most preferably n is from 0.2 to 0.5.

Sodium percarbonate, which is the preferred alkali metal percarbonate, is an addition compound having a formula corresponding to $2Na_2CO_3.3H_2O_2$, and is available commercially as a crystalline solid.

The median particle size of the coated percarbonate particles herein are preferably in the range 150 to 1400 microns, preferably 250 to 1000 microns.

In a preferred aspect of the invention sodium percarbonate is present as the only inorganic perhydrate salt. Other inorganic perhydrate salts may however, less desirably also be present. Examples of other inorganic perhydrate salts include perborate, perphosphate, persulfate and persilicate salts. The inorganic perhydrate salts are normally the alkali metal salts.

Peroxyacid Bleach Precursor

As a second essential component the compositions of the invention contain from 0.5% to 15% by weight, preferably from 0.8% to 8% by weight, most preferably from 1% to 6% by weight of a peroxyacid bleach precursor.

Peroxyacid bleach precursors for inclusion in the machine dishwashing detergent compositions in accordance with the invention can contain one or more N- or O- acyl groups, which precursors can be selected from a wide range of classes. Suitable classes include anhydrides, esters, imides and acylated derivatives of imidazoles and oximes, and examples of useful materials within these classes are disclosed in GB-A-1586789. The most preferred classes are esters such as are disclosed in GB-A-836988, 864798, 1147871 and 2143231 and imides such as are disclosed in GB-A-855735 & 1246338.

Particularly preferred bleach precursor compounds are the $N,N,N^1,N^1$ tetra acetylated compounds of formula $(CH_3CO)_2—N—(CH)_x—N—(CH_3CO)_2$, wherein x can be O or an integer between 1 & 6. Examples include tetra acetyl methylene diamine (TAMD) in which x=1, tetra acetyl ethylene diamine (TAED) in which x=2 and tetracetyl hexylene diamine (TAHD) in which x=6. These and analogous compounds are described in GB-A-907356. The most preferred peroxyacid bleach precursor is TAED.

Another preferred class of peroxyacid bleach activator compounds are the amide substituted compounds described in EP-A-0170386.

Useful peroxyacid bleach precursor compounds include sodium nonanoyloxy benzene sulfonate, sodium trimethyl hexanoyloxy benzene sulfonate, sodium acetoxy benzene sulfonate and sodium benzoyloxy benzene sulfonate as disclosed in, for example, EP-A-0341947.

Other useful peroxyacid bleach precursor compounds include the acyl lactams, especially the acyl caprolactams, particularly benzoyl caprolactam, and the acyl valerolactams, particularly nonanoyl valerolactam. Also useful are penta acetylated glucose (PAG) and 1-benzoyl-2, 3,4,6 tetra acetyl glucose.

Acidification Agent

The third essential component of the machine dishwashing detergent compositions of the invention is an acidification agent present at a level of from 0.1% to 40% by weight, preferably from 0.5% to 30%, more preferably from 1% to 25% by weight of the compositions.

By acidification agents herein it is meant any component which when released, acts such as to reduce the pH of the wash solution containing the dissolved/dispersed composition. Preferred acidification agents include inorganic and organic acids including, for example, carboxylate acids, such as citric and succinic acids, polycarboxylate acids, such as polyacrylic acid, and also acetic acid, boric acid, malonic acid, adipic acid, fumaric acid, lactic acid, glycolic acid, tartaric acid, tartronic acid, maleic acid, their derivatives and any mixtures of the foregoing. Bicarbonates, particularly sodium bicarbonate, are useful acidification agents herein. A highly preferred acidification acid is citric acid which has the advantage of providing builder capacity to the wash solution.

In an essential aspect of the invention the release of acidification agent into the wash solution does not occur immediately on introduction of the composition of the invention into the wash solution. Rather, there is a delayed release of said acidification agent such that the pH of the composition as a 1% solution in water at 20° C. is from 9.5 to 13.0 prior to release of the acidification agent, preferably from 9.8 to 12.0, and such that the pH of said composition as a 1% solution in water at 20° C. is from 9.3 to 7.0, preferably from 9.2 to 8.0 subsequent to complete release of the acidification agent.

Typically, complete release of said acidification agent occurs in a time period of from 30 seconds to 10 minutes, preferably from 2 minutes to 8 minutes, most preferably from 3 minutes to 7 minutes after introduction of the composition to the wash solution. Preferably, no acidification agent is released into the wash solution less than 30 seconds, more preferably less than 2 minutes, most preferably less than 3 minutes after introduction of the composition into the wash solution.

In a further essential aspect of the invention there is provided a means for enabling delayed release of the acidification agent.

Said means can include coating the acidification agent with a coating designed to provide said delayed release. The coating may therefore, for example, comprise a poorly water soluble material, or be a coating of sufficient thickness that the kinetics of dissolution of the thick coating provide the delayed release.

The coating material may be applied using various methods. The coating material is typically present at a weight ratio of coating material to acidification agent of from 1:99 to 1:2, preferably from 1:49 to 1:9.

Suitable coating materials include triglycerides (e.g. (partially) hydrogenated vegetable oil, soy bean oil, cotton seed oil) mono or diglcerides, microcrystalline waxes, gelatin, cellulose, fatty acids and any mixtures thereof.

A paticularly peferred coated acidification agent particle comprises an acidification agent, preferably citric acid, particle with a dual coating comprising an inner wax (paraffin) coating and an outer silica coating, wherein the wax (paraffin) typically has a melting point in the range 50° C. to 90° C. This dual coating allows for improved particle flow and for improved control over rate of dissolution in the wash solution.

One method for applying the coating material involves agglomeration. Any conventional agglomerator/mixer may be used including but not limited to pan, rotary drum and vertical blender types. Molten coating compositions may also be applied either by being poured onto, or spray atomized onto a moving bed of acid source comprising, for example, citric acid.

Other means of providing delayed release may include mechanical means for altering the physical characteristics of the acid to control its solubility and rate of release, particularly for acid compounds in dry form; suitable protocols could include compaction, mechanical injection, manual injection, solubility adjustment of the acid compound by selected particle size etc. Additional protocols could include ionic strength adjustment for regulating the rate of dissolution for the acid compound, thus altering characteristics of the acid itself, for example, by modifying a short chain carboxylic acid through the addition of branches or other groups.

A further delayed release means could involve blending of the acid compound with a less soluble or hydrophobic compound acting as a carrier, for example clays, zeolite, polymeric resins etc.

The present invention also encompasses a machine dishwashing method for cleaning soiled tableware comprising contacting said soiled tableware with a wash solution formed by dispersing therein an effective amount of a composition in accord with the invention, such that the initial pH of the said wash solution prior to release of the acidification agent component of the composition is from 9.5 to 13.0, preferably from 9.8 to 12.0, and such that the pH of the wash solution is from 9.3 to 7.0, preferably from 9.2 to 8.0, subsequent to complete release of the acidification agent.

By an effective amount of the machine dishwashing composition it is typically meant from 8 g to 60 g of product dispensed into from 3 to 10 liters of wash solution. The wash solution typically has a pH in the 9.5 to 13.0 region for a time period of from 30 seconds to 10 minutes, preferably from 2 minutes to 8 minutes, more preferably from 3 minutes to 7 minutes, subsequent to the introduction of the detergent composition to the wash solution.

Builder

A highly preferred component of the machine dishwashing detergent composition of the present invention is detergent builder compound present at a level of from 1% to 80% by weight, preferably from 5% to 70% by weight, most preferably from 10% to 60% weight of the composition.

Suitable detergent builder compound is largely or wholly water-soluble, and can, for example, be selected from monomeric polycarboxylates or their acid forms, homo or copolymeric polycarboxylic acids or their salts in which the polycarboxylic acid comprises at least two carboxylic radicals separated from each other by not more that two carbon atoms, carbonates, bicarbonates, borates, phosphates, silicates and mixtures of any of the foregoing.

Suitable water-soluble monomeric or oligomeric carboxylate builders can be selected from a wide range of compounds but such compounds preferably have a first carboxyl logarithmic acidity/constant ($pK_1$) of less than 9, preferably of between 2 and 8.5, more preferably of between 4 and 7.5.

The carboxylate or polycarboxylate builder can be momomeric or oligomeric in type although monomeric polycarboxylates are generally preferred for reasons of cost and performance. Monomeric and oligomeric builders can be selected from acyclic, alicyclic, heterocyclic and aromatic carboxylates.

Suitable carboxylates containing one carboxy group include the water soluble salts of lactic acid, glycolic acid and ether derivatives thereof as disclosed in Belgian Patent Nos. 831,368, 821,369 and 821,370. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates described in German Offenlegenschrift 2,446,686, and 2,446,687 and U.S. Pat. No. 3,935,257 and the sulfinyl carboxylates described in Belgian Patent No. 840,623. Polycarboxylates containing three carboxy groups include, in particular, water-soluble citrates, aconitrates and citraconates as well as. succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000.

Alicyclic and heterocyclic polycarboxylates include cyclopentane-cis,cis,cis-tetracarboxylates, cyclopentadienide pentacarboxylates, 2,3,4,5-tetrahydrofuran-cis,cis,cis-tetracarboxylates, 2,5-tetrahydrofuran-cis-dicarboxylates, 2,2,5,5-tetrahydrofuran-tetracarboxylates, 1,2,3,4,5,6-hexane-hexacarboxylates and carboxymethyl derivatives of polyhydric alcohols such as sorbitol, mannitol and xylitol. Aromatic polycarboxylates include mellitic acid, pyromellitic acid and the phthalic acid derivatives disclosed in British Patent No. 1,425,343.

Of the above, the preferred polycarboxylates are hydroxycarboxylates containing up to three carboxy groups per molecule, more particularly citrates.

The parent acids of the monomeric or oligomeric polycarboxylate chelating agents or mixtures thereof with their salts, e.g. citric acid or citrate/citric acid mixtures are also contemplated as components of builder systems of detergent compositions in accordance with the present invention.

Water-soluble detergent builders include, but are not limited to, the alkali metal, ammonium and alkanolammonium salts of polyphosphates (exemplified by the tripolyphosphates, pyrophosphates, and glassy polymeric meta-phosphates), phytic acid, silicates, carbonates (including bicarbonates and sesquicarbonates), and sulfates. Borate builders, as well as builders containing borate-forming materials that can produce borate under detergent storage or wash conditions can also be used but are not preferred at wash conditions less that about 50° C., especially less than about 40° C.

Specific examples of phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from about 6 to 21, and salts of phytic acid.

Suitable silicates include the water soluble sodium silicates with an $SiO_2$:$Na_2O$ ratio of from 1.0 to 2.8, with ratios of from 1.6 to 2.4 being preferred, and 2.0 ratio being most preferred. The silicates may be in the form of either the anhydrous salt or a hydrated salt. Sodium silicate with an $SiO_2$:$Na_2O$ ratio of 2.0 is the most preferred silicate.

Silicates are preferably present in the machine dishwashing detergent compositions at the invention at a level of from 1% to 50% by weight of the composition, more preferably from 5% to 40% by weight, most preferably from 3% to 15% by weight.

Whilst water-soluble detergent builders are essential components of the detergent compositions of the invention the compositions may also include less water soluble builders although preferably their levels of incorporation are minimized. Examples of such less water soluble builders include the crystalline layered silicates and the largely water insoluble sodium aluminosilicates. Suitable aluminosilicate zeolites have the unit cell formula $Na_z[(AlO_2)_z(SiO_2)y]$. $XH_2O$ wherein z and y are at least 6; the molar ratio of z to y is from 1.0 to 0.5 and x is at least 5, preferably from 7.5 to 276, more preferably from 10 to 264.

The builder component herein may also contain carbonate species, such as alkali metal carbonates and bicarbonates.

Organic Polymeric Dispersant Compound

It is an advantage of the present invention that levels of organic polymeric dispersant compound, commonly used to prevent formation of undesirable calcium carbonate deposits, may be reduced.

Preferably the compositions contain less than 10% by weight, more preferably less than 8% by weight, most preferably less than 6% by weight of organic dispersant compound. By organic polymeric dispersant compound it is meant essentially any polymeric organic compound commonly used as a dispersant in detergent compositions.

Examples of organic polymeric dispersant compounds include the water soluble organic homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of MWt 2000–5000 and their copolymers with maleic anhydride, such copolymers having a molecular weight of from 20,000 to 70,000, especially about 40,000.

Other organic polymeric dispersant compounds include the polymers of acrylamide and acrylate having a molecular weight of from 3,000 to 100,000, and the acrylate/fumarate copolymers having a molecular weight of from 2,000 to 80,000. Other organic polymeric compounds include the polyamino compounds such as those derived from aspartic acid such as those disclosed in EP-A-305282, EP-A-305283 and EP-A-351629. Preferred polyamino compounds include the homo and/or copolymers containing D/L or L/D aspartic acid with a molecular weight of from 1,500 to 20,000, preferably from 5,000 to 7,000.

Corrosion Inhibitor

The present compositions may also contain corrosion inhibitor. Such corrosion inhibitors are preferred components of machine dishwashing compositions in accord with the invention, and are preferably incorporated at a level of from 0.05% to 10%, preferably from 0.1% to 5% by weight of the total composition.

Suitable corrosion inhibitors include paraffin oil typically a predominantly branched aliphatic hydrocarbon having a number of carbon atoms in the range of from 20 to 50, a preferred paraffin oil being selected from predominantly branched $C_{25-45}$ species with a ratio of cyclic to noncyclic hydrocarbons of about 32:68. A paraffin oil meeting these characteristics is sold by Wintershall, Salzbergen, Germany, under the trade name WINOG 70.

Other suitable corrosion inhibitor compounds include benzotriazole and any derivatives thereof, mercaptans and diols, especially mercaptans with 4 to 20 carbon atoms including lauryl mercaptan, thiophenol, thionapthol, thionalide and thioanthranol. Also suitable are the $C_{12}$–$C_{20}$ fatty acids, or their salts, especially aluminium tristearate. The $C_{12}$–$C_{20}$ hydroxy fatty acids, or their salts, are also suitable. Phosphonated octa-decane and other anti-oxidants such as betahydroxytoluene (BHT) are also suitable.

Heavy Metal Ion Sequestrant

The detergent compositions of the invention may be formulated to contain as a non-essential component heavy metal ion sequestrant, incorporated at a level of from 0.005% to 3%, preferably 0.05 to 1%, most preferably 0.07% to 0.4%, by weight of the total composition.

Suitable heavy metal ion sequestrants for use herein include organic phosphonates, such as amino alkylene poly (alkylene phosphonate), alkali metal ethane 1-hydroxy diphosphonates and nitrilo trimethylene phosphonates.

Preferred among the above species are diethylene triamine penta (methylene phosphonate), hexamethylene diamine tetra (methylene phosphonate) and hydroxyethylene 1,1 diphosphonate.

The phosphonate compounds may be present either in their acid form or as a complex with either an alkali or alkaline metal ion, the molar ratio of said metal ion to said phosphonate compound being at least 1:1. Such complexes are described in U.S. Pat. No. 4,259,200. Preferably, the organic phosphonate compounds are in the form of their magnesium salt.

Other suitable heavy metal ion sequestrants for use herein include nitrilotriacetic acid and polyaminocarboxylic acids such as ethylenediaminotetracetic acid, ethylenetriamine pentacetic acid, ethylenediamine disuccinic acid or the water soluble alkali metal salts thereof.

Especially preferred is ethylenediamine-N,N'-disuccinic acid (EDDS) or the alkali metal, alkaline earth metal, ammonium, or substituted ammonium salts thereof, or mixtures thereof. Preferred EDDS compounds are the free acid form and the sodium or magnesium salt or complex thereof. Examples of such preferred sodium salts of EDDS include $Na_2$EDDS and $Na_3$EDDS. Examples of such preferred magnesium complexes of EDDS include MgEDDS and $Mg_2$EDDS. The magnesium complexes are the most preferred for inclusion in compositions in accordance with the invention.

Still other suitable heavy metal ion sequestrants for use herein are iminodiacetic acid derivatives such as 2-hydroxyethyl diacetic acid or glyceryl imino diacetic acid, described in EPA 317 542 and EPA 399 133.

The heavy metal ion sequestrant herein can consist of a mixture of the above described species.

Surfactant System

A highly preferred component of the machine dishwashing compositions of the invention is a surfactant system comprising surfactant selected from anionic, cationic, nonionic ampholytic and zwitterionic surfactants and mixtures thereof. The surfactant system may be present at a level of from 0.5% to 30% by weight, more preferably 1% to 25% by weight, most preferably from 2% to 20% by weight of the compositions.

A typical listing of anionic,. nonionic, ampholytic and zwitterionic classes, and species of these surfactants, is given in U.S. Pat. No. 3,929,678 issued to Laughlin and Heuring on Dec. 30, 1975. A list of suitable cationic surfactants is given in U.S. Pat. No. 4,259,217 issued to Murphy on Mar. 31, 1981. A listing of surfactants typically included in automatic dishwashing detergent compositions is given in EP-A-0414 549.

Sulphonate and sulphate surfactants are useful herein. Sulphonates include alkyl benzene sulphonates having from 5 to 15 carbon atoms in the alkyl radical, and alpha-sulphonated methyl fatty acid esters in which the fatty acid is derived from a $C_6$–$C_{18}$ fatty source. Preferred sulphate surfactants are alkyl sulphates having from 6 to 16, preferably 6 to 10 carbon atoms in the alkyl radical.

A useful surfactant system comprises a mixture of two alkyl sulphate materials whose respective mean chain lengths differ from each other. The cation in each instance is again an alkali metal, preferably sodium. The alkyl sulfate salts may be derived from natural or synthetic hydrocarbon sources.

The $C_6$–$C_{16}$ alkyl ethoxysulfate salt comprises a primary alkyl ethoxysulfate which is derived from the condensation product of a $C_6$–$C_{16}$ alcohol condensed with an average of from one to seven ethylene oxide groups, per mole. Preferred are the $C_6$–$C_{10}$ alkyl ethoxysulfate salts with an average of from one to five ethoxy groups per mole.

Other anionic surfactants suitable for the purposes of the invention are the alkali metal sarcosinates of formula $$R—CON(R^1)CH_2COOM$$

wherein R is a $C_5$–$C_{17}$ linear or branched alkyl or alkenyl group, $R^1$ is a $C_1$–$C_4$ alkyl group and M is an alkali metal ion. Preferred examples are the lauroyl, Cocoyl ($C_{12}$–$C_{14}$), myristyl and oleyl methyl sarcosinates in the form of their sodium salts.

Other anionic surfactants useful herein comprise the alkyl ester sulfonate surfactants which include linear esters of $C_8$–$C_{20}$ carboxylic acids (i.e., fatty acids) which are sulfonated with gaseous $SO_3$ according to "The Journal of the American Oil Chemists Society," 52 (1975), pp. 323–329. Suitable starting materials would include natural fatty substances as derived from tallow, palm oil, etc.

The preferred alkyl ester sulfonate surfactants have the structural formula:

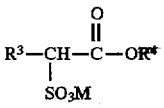

wherein $R^3$ is a $C_8$–$C_{20}$ hydrocarbyl, preferably an alkyl, or combination thereof, $R^4$ is a $C_1$–$C_6$ hydrocarbyl, preferably an alkyl, or combination thereof, and M is a cation which forms a water soluble salt with the alkyl ester sulfonate. Suitable salt-forming cations include metals such as sodium, potassium, and lithium, and substituted or unsubstituted ammonium cations, such as monoethanolamine, diethanolamine, and triethanolamine. Preferably, $R^3$ is $C_{10}$–$C_{16}$ alkyl, and $R^4$ is methyl, ethyl or isopropyl. Especially preferred are the methyl ester sulfonates wherein $R^3$ is $C_{10}$–$C_{16}$ alkyl.

One class of nonionic surfactants useful in the present invention comprises the water soluble ethoxylated $C_6$–$C_{16}$ fatty alcohols and $C_6$–$C_{16}$ mixed ethoxylated/propoxylated fatty alcohols and mixtures thereof. Preferably the ethoxylated fatty alcohols are the $C_{10}$–$C_{16}$ ethoxylated fatty alcohols with a degree of ethoxylation of from 3 to 50, most preferably these are the $C_{12}$–$C_{16}$ ethoxylated fatty alcohols with a degree of ethoxylation from 3 to 40. Preferably the mixed ethoxylated/propoxylated fatty alcohols have an alkyl chain length of from 10 to 16 carbon atoms, a degree of ethoxylation of from 3 to 30 and a degree of propoxylation of from 1 to 10.

Thus $C_6$–$C_{16}$ alcohol itself can be obtained from natural or synthetic sources. Thus, $C_6$–$C_{16}$ alcohols, derived from natural fats, or Ziegler olefin build-up, or OXO synthesis can form suitable sources for the alkyl group. Examples of synthetically derived materials include Dobanol 25 (RTM) sold by Shell Chemicals (UK) Ltd which is a blend of $C_{12}$–$C_{15}$ alcohols, Ethyl 24 sold by the Ethyl Corporation, which is a blend of $C_{12}$–$C_{15}$ alcohols, a blend of $C_{13}$–$C_{15}$ alcohols in the ratio 67% $C_{13}$, 33% $C_{15}$ sold under the trade name Lutensol by BASF GmbH and Synperonic (RTM) by ICI Ltd., and Lial 125 sold by Liquichimica Italiana. Examples of naturally occuring materials from which the alcohols can be derived are coconut oil and palm kernel oil and the corresponding fatty acids.

Another class of nonionic surfactants comprises alkyl polyglucoside compounds of general formula $$RO(c_nH_{2n}O)_tZ_x$$

wherein Z is a moiety derived from glucose; R is a saturated hydrophobic alkyl group that contains from 6 to 16 carbon atoms preferably from 6 to 14 carbon atoms; t is from 0 to 10 and n is 2 or 3; x is from 1.1 to 4, the compounds including less than 10% unreacted fatty alcohol and less than 50% short chain alkyl polyglucosides. Compounds of this type and their use in detergent compositions are disclosed in EP-B 0070074, 0070077, 0075996 and 0094118.

Another preferred nonionic surfactant is a polyhydroxy fatty acid amide surfactant compound having the structural formula:

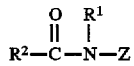

wherein $R^1$ is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{15}$ hydrocarbyl, preferably straight chain $C_5$–$C_{13}$ alkyl or alkenyl, more preferably straight chain $C_5$–$C_{11}$ alkyl or alkenyl, most preferably straight chain $C_5$–$C_9$ alkyl or alkenyl, or mixture thereof: and Z is a polyhydroxyhydrocarbyl having a linear hydrocarbyl chain with at least 3 hydroxyls directly connected to the chain, or an alkoxlylated derivative (preferably ethoxylated or propoxylated) thereof. Z preferably will be derived from a reducing sugar in a reductive amination reaction; more preferably Z is a glycityl.

A further class of surfactants are the semi-polar surfactants such as amine oxides. Suitable amine oxides are selected from mono $C_6$–$C_{20}$, preferably $C_6$–$C_{16}$ N-alkyl or alkenyl amine oxides and propylene-1,3-diamine dioxides wherein the remaining N positions are substituted by methyl, hydroxyethyl or hydroxpropyl groups.

Cationic surfactants can also be used in the detergent compositions herein and suitable quaternary ammonium surfactants are selected from mono $C_6$–$C_{16}$, preferably $C_6$–$C_{10}$ N-alkyl or alkenyl ammonium surfactants wherein remaining N positions are substituted by methyl, hydroxyethyl or hydroxypropyl groups.

Another optional ingredient useful in detergent compositions is one or more enzymes.

Preferred enzymatic materials include amylases, neutral and alkaline proteases, lipases, and esterases conventionally incorporated into detergent compositions. Suitable enzymes are discussed in U.S. Pat. Nos. 3,519,570 and 3,533,139.

Preferred commercially available protease enzymes include those sold under the tradenames Alcalase and Savinase by Novo Industries A/S (Denmark) and Maxatase by International Bio-Synthetics, Inc. (The Netherlands). Protease enzyme may be incorporated into the compositions in accordance with the invention at a level of from 0.005% to 2% active enzyme by weight of the composition.

Preferred amylases include, for example, α-amylases obtained from a special strain of B licheniforms, described in more detail in GB 1,269,839 (Novo). Preferred commercially available amylases include for example, Rapidase, sold by International Bio-Synthetics Inc, and Termamyl, sold by Novo Industries A/S. The invention at a level of from 0.001% to 2% active enzyme by weight of the composition.

A preferred lipase is derived from *Pseudomonas pseudoalcaligenes,* which is described in Granted European Patent, EP-B-0218272.

Another preferred lipase herein is obtained by cloning the gene from *Humicola lanuginosa* and expressing the gene in *Aspergillus oryza,* as host, as described in European Patent Application, EP-A-0258068, which is commercially available from Novo Industri A/S, Bagsvaerd, Denmark, under the trade name Lipolase. This lipase is also described in U.S. Pat. No. 4,810,414, Huge-Jensen et al, issued Mar. 7, 1989.

Lime Soap Dispersant Compound

The compositions of the invention may contain a lime soap dispersant compound, which has a lime soap dispersing power (LSDP), as defined hereinafter of no more than 8, preferably no more than 7, most preferably no more than 6. The lime soap dispersant compound is preferably present at a level of from 0.1% to 40% by weight, more preferably 1% to 20% by weight, most preferably from 2% to 10% by weight of the compositions.

A lime soap dispersant is a material that prevents the precipitation of alkali metal, ammonium or amine salts of fatty acids by calcium or magnesium ions. A numerical measure of the effectiveness of a lime soap dispersant is given by the lime soap dispersing power (LSDP) which is determined using the lime soap dispersion test as described in an article by H. C. Borghetty and C. A. Bergman, J. Am. Oil. Chem. Soc., volume 27, pages 88–90, (1950). This lime soap dispersion test method is widely used by practitioners in this art field being referred to , for example, in the following review articles; W. N. Linfield, Surfactant Science Series, Volume 7, p3; W. N. Linfield, Tenside Surf. Det. , Volume 27, pages 159–161, (1990); and M. K. Nagarajan, W. F. Masler, Cosmetics and Toiletries, Volume 104, pages 71–73, (1989). The LSDP is the % weight ratio of dispersing agent to sodium oleate required to disperse the lime soap deposits formed by 0.025 g of sodium oleate in 30 ml of water of 333 ppm $CaCO_3$ (Ca:Mg=3:2) equivalent hardness.

Polymeric lime soap dispersants suitable for use herein are described in the article by M. K. Nagarajan and W. F. Masler, to be found in Cosmetics and Toiletries, Volume 104, pages 71–73, (1989). Examples of such polymeric lime soap dispersants include certain water-soluble salts of copolymers of acrylic acid, methacrylic acid or mixtures thereof, and an acrylamide or substituted acrylamide, where such polymers typically have a molecular weight of from 5,000 to 20,000.

Surfactants having good lime soap dispersant capability will include certain amine oxides, betaines, sulfobetaines, alkyl ethoxysulfates and ethoxylated alcohols.

Exemplary surfactants having a LSDP of no more than 8 for use in accord with the invention include $C_{16}$–$C_{18}$ dimethyl amine oxide, $C_{12}$–$C_{18}$ alkyl ethoxysulfates with an average degree of ethoxylation of from 1–5, particularly $C_{12}$–$C_{15}$ alkyl ethoxysulfate surfactant with a degree of ethoxylation of about 3 (LSDP=4), and the $C_{13}$–$C_{15}$ ethoxylated alcohols with an average degree of ethoxylation of either 12 (LSDP=6) or 30, sold under the trade names Lutensol A012 and Lutensol A030 respectively, by BASF GmbH.

Suds Suppressing System

The detergent compositions of the invention preferably comprise a suds suppressing system present at a level of from 0.01% to 15%, preferably from 0.05% to 10%, most preferably from 0.1% to 5% by weight of the composition.

Suitable suds suppressing systems for use herein may comprise essentially any known antifoam compound, including, for example silicone antifoam compounds, 2-alkyl alcanol antifoam compounds, and paraffin antifoam compounds.

By antifoam compound it is meant herein any compound or mixtures of compounds which act such as to depress the foaming or sudsing produced by a solution of a detergent composition, particularly in the presence of agitation of that solution.

Particularly preferred antifoam compounds for use herein are silicone antifoam compounds defined herein as any antifoam compound including a silicone component. Such silicone antifoam compounds also typically contain a silica component. The term "silicone" as used herein, and in general throughout the industry, encompasses a variety of relatively high molecular weight polymers containing siloxane units and hydrocarbyl group of various types.

Other suitable antifoam compounds include the monocarboxylic fatty acids and soluble salts thereof. These materials are described in U.S. Pat. No. 2,954,347, issued Sep. 27, 1960 to Wayne St. John. The monocarboxylic fatty acids, and salts thereof, for use as suds suppressor typically have hydrocarbyl chains of 10 to about 24 carbon atoms, preferably 12 to 18 carbon atoms. Suitable salts include the alkali metal salts such as sodium, potassium, and lithium salts, and ammonium and alkanolammonium salts.

Other suitable antifoam compounds include, for example, high molecular weight hydrocarbons such as paraffin, fatty esters (e.g. fatty acid triglycerides), fatty acid esters of monovalent alcohols, aliphatic $C_{18}$–$C_{40}$ ketones (e.g. stearone) N-alkylated amino triazines such as tri- to hexa-alkylmelamines or di- to tetra alkyldiamine chlortriazines formed as products of cyanuric chloride with two or three moles of a primary or secondary amine containing 1 to 24 carbon atoms, propylene oxide, bis stearic acid amide and monostearyl di-alkali metal (e.g. sodium, potassium, lithium) phosphates and phosphate esters. The hydrocarbons, such as paraffin and haloparaffin, can be utilized in liquid form. The liquid hydrocarbons will be liquid at room temperature and atmospheric pressure, and will have a pour point in the range of about –40° C. and about 5° C., and a minimum boiling point not less than 110° C. (atmospheric pressure). It is also known to utilize waxy hydrocarbons, preferably having a melting point below about 100° C. Hydrocarbon suds suppressors are described, for example, in U.S. Pat. No. 4,265,779, issued May 5, 1981 to Gandolfo et al. The hydrocarbons, thus, include aliphatic, alicyclic, aromatic, and heterocyclic saturated or unsaturated hydrocarbons having from about 12 to about 70 carbon atoms. The term "paraffin", as used in this suds suppressor discussion, is intended to include mixtures of true paraffins and cyclic hydrocarbons.

Copolymers of ethylene oxide and propylene oxide, particularly the mixed ethoxylated/propoxylated fatty alcohols with an alkyl chain length of from 10 to 16 carbon atoms, a degree of ethoxylation of from 3 to 30 and a degree of propoxylation of from 1 to 10, are also suitable antifoam compounds for use herein.

Suitable 2-alky-alcanols antifoam compounds for use herein have been described in DE 40 21 265. The 2-alkyl-alcanols suitable for use herein consist of a $C_6$ to $C_{16}$ alkyl chain carrying a terminal hydroxy group, and said alkyl chain is substituted in the alpha position by a $C_1$ to $C_{10}$ alkyl chain. Mixtures of 2-alkyl-alcanols can be used in the compositions according to the present invention.

Other Optional Ingredients

Other optional ingredients suitable for inclusion in the compositions of the invention include antiredeposition, and soil-suspension agents, perfumes, colours and filler salts, with sodium sulfate being a preferred filler salt.

Form of the Compositions

The machine dishwashing compositions of the invention can be formulated in any particulate solid form such as powders and granulates, with granular forms being preferred.

Making Processes

In general, granular detergent compositions in accordance with the present invention can be made via a variety of methods including dry mixing, spray drying, agglomeration and granulation.

The bulk density of the granular detergent compositions in accordance with the present invention typically have a bulk density of at least 650 g/liter, more usually at least 700 g/liter and more preferably from 800 g/liter to 1200 g/liter.

Bulk density is measured by means of a simple funnel and cup device consisting of a conical funnel moulded rigidly on a base and provided with a flap valve at its lower extremity to allow the contents of the funnel to be emptied into an axially aligned cylindrial cup disposed below the funnel. The funnel is 130 mm and 40 mm at its respective upper and lower extremities. It is mounted so that the lower extremity is 140 mm above the upper surface of the base. The cup has an overall height of 90 mm, an internal height of 87 mm and an internal diameter of 84 mm. Its nominal volume is 500 ml.

To carry out a measurement, the funnel is filled with powder by hand pouring, the flap valve is opened and powder allowed to overfill the cup. The filled cup is removed from the frame and excess powder removed from the cup by passing a straight edged implement e.g. a knife, across its upper edge. The filled cup is then weighed and the value obtained for the weight of powder doubled to provide the bulk density in g/liter. Replicate measurements are made as required.

The particle size of the components of granular compositions in accordance with the invention should preferably be such that no more that 5% of particles are greater than 1.4 mm in diameter and not more than 5% of particles are less than 0.15 mm in diameter.

EXAMPLES

The following examples illustrate the present invention.

In the following detergent compositions, the abbreviated identifications have the following meanings:

Citric acid particle 1: A citric acid particle coated with hydrogenated vegetable oil at a coating level of approximately 3% by weight of the particle Citric acid particle 2: A citric acid particle coated with a dual coating comprising an inner coating of 6% by weight of the particle of paraffin wax of melting point 50°–60° C. and an outer coating of hydrophobic silica at a level of 1.5% by weight of the particle.

Citric acid particle 3: A citric acid particle coated with 6% by weight of the particle of a paraffin wax of melting point 50°–60° C.

Bicarbonate particle: Compacted sodium bicarbonate of particle size 150 μm to 900 μm.

Citrate: Sodium citrate

Silicate: Anhydrous sodium silicate with $SiO_2$:$Na_2O$ ratio of 2.0:1

MA/AA: Copolymers of 1:4 maleic/acrylic acid, average molecular weight about 80,000

Carbonate: Anhydrous sodium carbonate

480N: Random copolymers of acrylic acid and methacrylic acid in a weight ratio of approximately 30:70, with a molecular weight of about 3,500

Polyaspartate: Organic polyaspartate dispersant polymer comprising a homopolymer of D/L aspartic acid with a molecular weight of 5,000–7,000.

Percarbonate: Anhydrous sodium percarbonate bleach of empirical formula $2Na_2CO_3.3H_2O_2$ coated with a mixed salt of formula $Na_2SO_4.n.Na_2CO_3$ where n is 0.29 and where the weight ratio of percarbonate:mixed salt is 39:1.

Lipase: Lipolytic enzyme sold under the tradename lipolase by Novo Industries A/S Protease: Proteolytic enzyme sold under the trade name Savinase by Novo Industries A/S Amylase: Amylolytic enzyme sold under the trade name Termamyl by Novo Industries A/S AE3S particle: Agglomerated particles comprising by weight of the particles appoximately 32% by weight of 2.0 ratio silicate, 10% by weight of $C_{12}$–$C_{15}$ alkyl ethoxysulfate with a degree of ethoxylation of 3, 10% sodium carbonate, 36% sodium sulfate and water/miscellaneous to balance TAED: Tetraacetyl ethylene diamine DETPMP: Diethylene triamine penta (methylene) phosphonic acid Suds suppressor: A particulate agglomerate component comprising 11% by weight of polydimethylsiloxane, 14% by weight TAE80, 5% by weight of $C_{12}$–$C_{22}$ hydrogenated fatty acids and 70% by weight of starch Paraffin: Paraffin oil, a mixture of $C_{25-45}$ species with a high degree of branching and ratio of cyclic:noncyclic hydrocarbons of about 32:68, sold as Winog 70 (tradename) by Wintershall

EXAMPLE 1

The following machine dishwashing detergent compositions, in accord with the invention, are prepared (parts by weight).

| | A | B | C | D |
|---|---|---|---|---|
| Citric acid particle 1 | 15.0 | — | — | 10.0 |
| Citric acid particle 2 | — | 15.0 | — | — |
| Citric acid particle 3 | — | — | 15.0 | — |
| Bicarbonate particle | — | — | — | 10.0 |
| Citrate | 4.0 | 4.0 | 4.0 | 8.0 |
| Silicate | 13.0 | 13.0 | 13.0 | 13.0 |
| Carbonate | 9.0 | 9.0 | 9.0 | — |
| MA/AA | — | 4.0 | — | 5.0 |
| 480N | 6.0 | — | — | — |
| Polyaspartate | — | — | 5.0 | — |
| AE3S particle | 3.0 | 3.0 | 3.0 | 3.0 |
| Percarbonate | 10.5 | 12.0 | 8.0 | 8.0 |
| Protease | 1.6 | 1.6 | 1.6 | 1.6 |
| Amylase | 1.5 | 1.5 | 1.5 | 1.5 |
| Lipase | — | — | 1.5 | 1.5 |
| TAED | 3.8 | 3.8 | 3.8 | 4.4 |
| Paraffin | — | — | 0.5 | 0.5 |
| Benzotriazole | — | — | 0.3 | 0.3 |
| DETPMP | 0.13 | 0.13 | 0.13 | 0.13 |
| Suds suppressor particle | 2.0 | 2.0 | | 2.0 |

-continued

| | A | B | C | D |
|---|---|---|---|---|
| Sulphate/misc/ moisture to balance | | | | |

The compositions A–D gave good cleaning performance when employed in a machine dishwashing method in accord with the invention.

I claim:

1. A particulate solid machine dishwashing composition comprising:

(a) from 3% to 40% by weight of an alkali metal percarbonate bleach coated with a mixed salt comprising an alkali metal carbonate and an alkali metal sulphate salt;

(b) from 0.5% to 15% by weight of a peroxyacid bleach precursor;

(c) from 0.1% to 40% by weight of an acidification agent;

(d) from 0.05% to 10% by weight of a corrosion inhibitor;

wherein the acidification agent is provided with a coating enabling the delayed release of said acidification agent, the coating comprising an inner coating comprising wax and an outer coating comprising silica such that the pH of said composition as a 1% solution in water at 20° C. is from 9.5 to 13.0 prior to release of said acidification agent, and such that the pH of said composition as a 1% solution in water at 20° C. is from 9.3 to 7.0 subsequent to complete release of said acidification agent.

2. A machine dishwashing detergent composition according to claim 1 wherein said mixed salt is present at a weight ratio of mixed salt to alkali metal percarbonate bleach of from 1:99 to 1:9.

3. A machine dishwashing detergent composition according to claim 1 wherein said mixed salt has the general formula $Na_2SO_4.n.Na_2CO_3$ wherein n is from 0.3 to 1.0.

4. A machine dishwashing detergent composition according to claim 1 wherein said coated alkali metal percarbonate bleach is present at a level of from 4% to 30% by weight of the composition.

5. A machine dishwashing detergent composition according to claim 1 wherein said peroxyacid bleach precursor is tetra acetyl ethylene diamine present at a level of from 1% to 6% by weight of the composition.

6. A machine dishwashing detergent composition according to claim 1 wherein said acidification agent is citric acid present at a level of from 1% to 25% by weight of the composition.

7. A machine dishwashing detergent composition according to claim 1, further comprising from 0.5% to 30% by weight, of a surfactant system.

8. A machine dishwashing detergent composition according to claim 1, further comprising from 0.1% to 40% by weight, of a lime soap dispersant.

9. A machine dishwashing detergent composition according to claim 1, further comprising an additional component selected from the group consisting of a suds suppressor, a heavy metal ion sequesterants, an organic polymeric dispersant and an enzyme.

10. A machine dishwashing detergent composition according to claim 1, wherein the corrosion inhibitor is selected from the group consisting of:

paraffin oil, benzotriazole, lauryl mercaptan, thiophenol, thionapthol, thionalide, thioanthranol, aluminum tristearate, $C_{12}$ to $C_{20}$ hydroxy fatty acids, phosphated octa-decane, betahydroxytoluene and mixtures thereof.

11. A machine dishwashing method for cleaning soiled tableware comprising contacting said soiled tableware with a wash solution formed by dispensing therein an effective amount of a composition according to claim 1, such that the initial pH of said wash solution prior to release of said acidification agent is from 9.5 to 13.0, and such that the pH of said wash solution is from 9.3 to 7.0 subsequent to complete release of said acidification agent.

* * * * *